US005339348A

United States Patent [19]

Wirth et al.

[11] Patent Number: 5,339,348

[45] Date of Patent: Aug. 16, 1994

[54] X-RAY TUBE ROTOR CONTROLLER USING THE MAIN HIGH VOLTAGE INVERTERS FOR ACCELERATION

[75] Inventors: William F. Wirth, Sullivan; Jonathan R. Schmidt, Wales, both of Wis.

[73] Assignee: General Electric Company, Milwaukee, Wis.

[21] Appl. No.: 970,512

[22] Filed: Nov. 2, 1992

[51] Int. Cl.[5] ..... H05G 1/66

[52] U.S. Cl. ..... 378/93; 378/91

[58] Field of Search ..... 378/93, 94

[56] References Cited

U.S. PATENT DOCUMENTS 4,247,776 1/1981 Seifert ..... 378/93

4,377,002 3/1983 Krause et al. ..... 378/93

*Primary Examiner*—Craig E. Church

*Attorney, Agent, or Firm*—Barbara Joan Haushalter; Robert R. Schroeder

[57] ABSTRACT

An x-ray tube rotor controller uses the main high voltage inverters for acceleration. The rotor controller includes a DC voltage source, and a rotary anode drive circuit including a rotary anode motor designed as an induction motor. A first inverter circuit has a full bridge arrangement for accelerating the anode using a first switch to connect the induction motor to the full bridge output, and also generates high voltage for the x-ray tube. Once the anode is up to operating speed, the first switch is disconnected from the rotor causing the rotor to coast. Alternatively, a second small inverter may be employed for maintaining the rotor at speed during x-ray exposure, rather than allowing the rotor to coast. In such an instance, the first switch is disconnected from the rotor when the motor reaches a rated anode speed, and a second switch then connects the motor to the second inverter to maintain the rated anode speed. Finally, if the x-ray generator has separate anode and cathode inverters, a third small two-phase inverter may be employed in the system for driving the second phase of the anode driver motor.

9 Claims, 3 Drawing Sheets

X-RAY TUBE ROTOR CONTROLLER USING THE MAIN HIGH VOLTAGE INVERTERS FOR ACCELERATION

TECHNICAL FIELD

The present invention relates to an x-ray tube rotor controller and, more particularly, to an x-ray tube rotor controller using the main high voltage inverters for acceleration.

BACKGROUND ART

X-ray tubes used in medical diagnostic imaging are built with a rotating anode structure for the purpose of distributing the heat generated at the focal spot. This anode is rotated by an induction motor consisting of a cylindrical rotor built into a cantilevered axle that supports the disc shaped anode target, and an iron stator structure with copper windings that surrounds the elongated neck of the x-ray tube that contains the rotor. This induction motor requires a source of alternating current which is normally supplied from the power mains or an inverter.

A typical state-of-the-art x-ray diagnostic system uses a high frequency inverter to supply alternating current to a step up transformer and rectifier/filter circuit that generates the high voltage DC power required by the x-ray tube. A separate inverter supplies AC voltage to the induction motor that rotates the anode. This second inverter is sized to quickly accelerate the anode to about 10,000 RPM and is typically rated about 10 KVA. Once the anode is up to rated speed, the load drops to a very small percentage of rated, due to absence of air friction in the vacuum inside the tube.

In U.S. Pat. No. 4,377,002, the anode drive induction motor is accelerated by using one leg of a full bridge inverter and an additional DC voltage source tapped at its midpoint to form a half bridge. During this time, the other leg of the full bridge is deenergized so as to prevent any voltage from being applied to the x-ray tube load. This requires the use of an additional voltage divider circuit, adding to the overall cost of the system. The generator disclosed in the '002 patent has the further disadvantage of additional power dissipation, resulting from the use of the additional circuitry.

It would be desirable then to have a rotor controller wherein the voltage divider circuit is eliminated, thereby resulting in the additional benefit of eliminating power dissipation created by the voltage divider circuit.

SUMMARY OF THE INVENTION

The present invention is a system and method wherein the inverter normally used to generate the high voltage for the x-ray tube is used to accelerate the anode, thereby eliminating the additional voltage divider circuit. In one embodiment, a second smaller inverter may be added to maintain the rotor at speed during the x-ray exposure. Advantage is taken of the fact that the frequency of operation of the inverter while in the motor acceleration mode is about 1% of the frequency used while generating power for the x-ray exposure. The invention relies on impedance of a series capacitor to prevent high voltage.

In accordance with one aspect of the present invention, an x-ray tube rotor controller uses the main high voltage inverters for acceleration. The rotor controller includes a DC voltage source, and a rotary anode drive circuit including a rotary anode motor designed as an induction motor. A first inverter circuit has a full bridge arrangement for accelerating the anode using a first switch to connect the induction motor to the full bridge output, and also generates high voltage for the x-ray tube. Once the anode is up to operating speed, the first switch is disconnected from the rotor causing the rotor to coast. Alternatively, a second small inverter may be employed for maintaining the rotor at speed during x-ray exposure, rather than allowing the rotor to coast. In such an instance, the first switch is disconnected from the rotor when the motor reaches a rated anode speed, and a second switch then connects the motor to the second inverter to maintain the rated anode speed.

In an alternative embodiment, when the x-ray generator has separate anode and cathode inverters, a third small two-phase inverter is employed. In this embodiment, the x-ray tube rotor controller comprises a DC voltage source, and a rotary anode drive circuit including a rotary anode motor designed as a two-phase induction motor. This embodiment is characterized in that the x-ray tube rotor controller comprises an anode inverter circuit and a separate cathode inverter circuit, the anode and cathode inverter circuits each having a full bridge arrangement for accelerating the anode using a first switching means to connect the induction motor to the full bridge output of each inverter circuit, and further for generating high voltage for the x-ray tube, and further comprising a second switching means for connecting the two windings of the motor to the third, two-phase, inverter to maintain a rated anode speed of the motor.

Accordingly, it is an object of the present invention to provide an x-ray tube rotor controller to eliminate the additional voltage divider circuit of existing systems.

Other objects and advantages of the invention will be apparent from the following description, the accompanying drawings and the appended claims.

DETAILED DESCRIPTION OF THE PREFERRED EMBODIMENTS

The present invention relates to an arrangement whereby the inverter normally used to generate the high voltage for the x-ray tube is used to accelerate the anode, without turning off half of the bridge, and a second very small inverter may be used to maintain the rotor at speed during the x-ray exposure.

Figure 1:
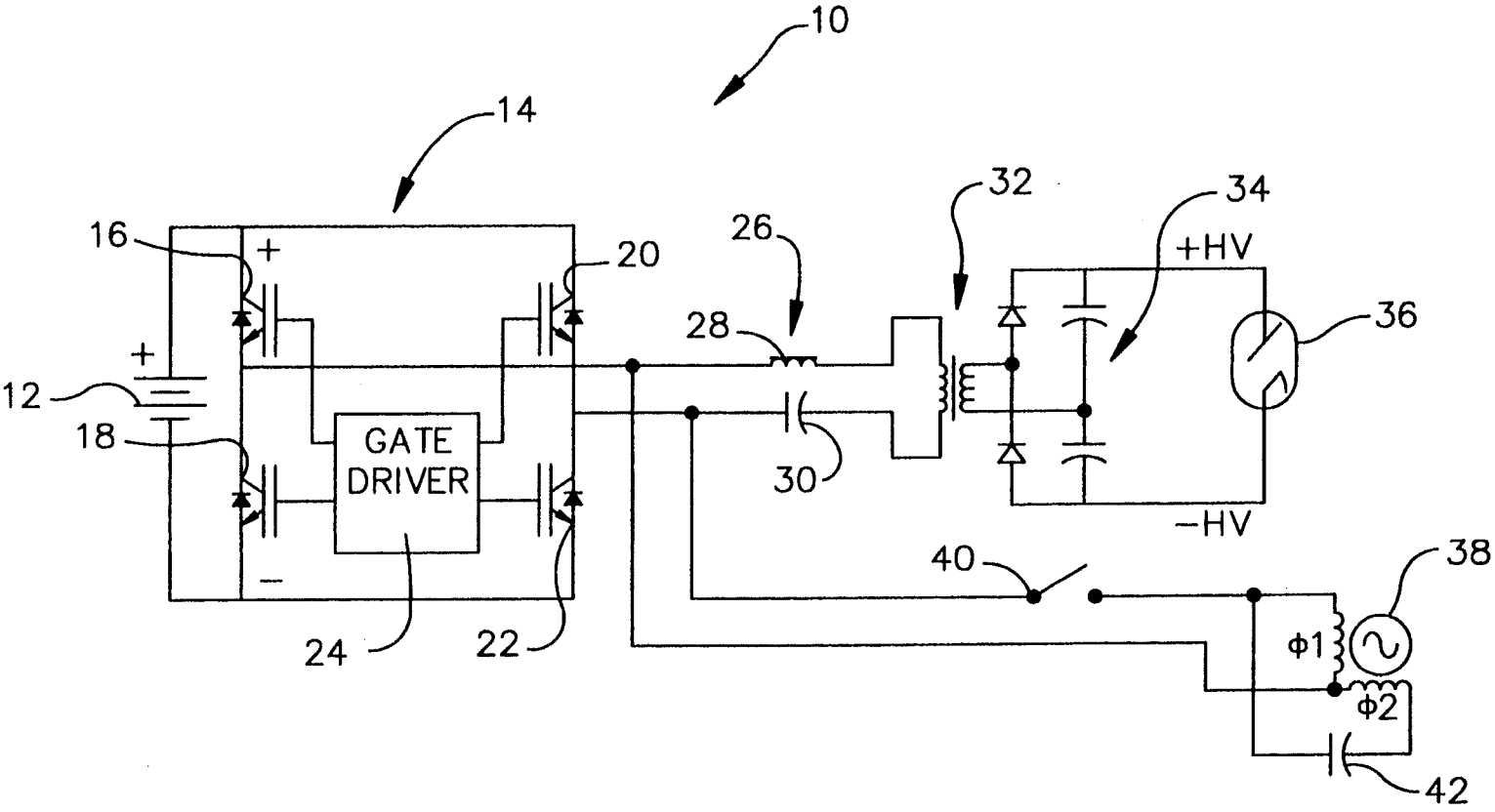
FIG. 1 is an electric circuit diagram, in accordance with one embodiment of the present invention.

Referring now to the drawings, FIG. 1 illustrates an x-ray tube rotor controller electric circuit 10 in accordance with one embodiment of the present invention. The invention shown in FIG. 1 includes a DC voltage source 12 for providing voltage to a full bridge inverter 14 comprising four electronic switches 16, 18, 20 and 22, and a gate driver 24. The electric circuit 10 further includes a resonant circuit 26 comprised of a series connected inductor 28 and capacitor 30. A high voltage step up transformer 32 and a rectifier and filter circuit 34 comprise a series connected output for an x-ray tube 36. An induction motor 38, for driving the x-ray tube 36 anode, is connected or disconnected from the circuit 10 via a motor disconnect switch 40. Finally, the circuit 10 includes a phase shifting capacitor 42, so the motor 38 is connected in a single phase capacitor run configuration.

To accelerate the anode, the induction motor 38 is connected by the switch 40 to the output of the full bridge 14, which generates a bipolar square wave output at a synchronous frequency corresponding to the desired operating speed of the motor 38. During acceleration, the x-ray load and the series resonant circuit 26 are left connected to the full bridge. At 180 Hz, however, the impedance of the series capacitor 30 in the resonant circuit 26 is very high and limits the power to the tube 36. This is best illustrated by example, wherein the impedance of a 0.4 $\mu$F capacitor is about 2210Ω at 180 Hz, and would be reflected to the secondary of a step up transformer 32 by the square of the turns ratio, typically 150, as $(150^2*2210\Omega)=50M\Omega$. With a filament current corresponding to a typical operating technique, the x-ray tube's resistance is in the range of 1MΩ. Thus, approximately 1MΩ/50MΩ, or 2%, of the maximum output would be applied to the x-ray tube. This would typically be 2% of 150KV, or 3000 volts, which is well under the voltage required to produce harmful radiation.

Once the anode is up to operating speed, the motor disconnect switch 40 is opened, and the anode is left to coast down at a deceleration rate that is very slow, due to the low friction in the vacuum of the x-ray tube. This is particularly practical in applications where the exposure is made shortly after acceleration. The full bridge 14 is now available to run the x-ray tube load at a frequency near the resonance of the series L-C circuit 26, typically 20 KHz, where it is capable of producing rated voltage, typically 150KV.

Figure 2:
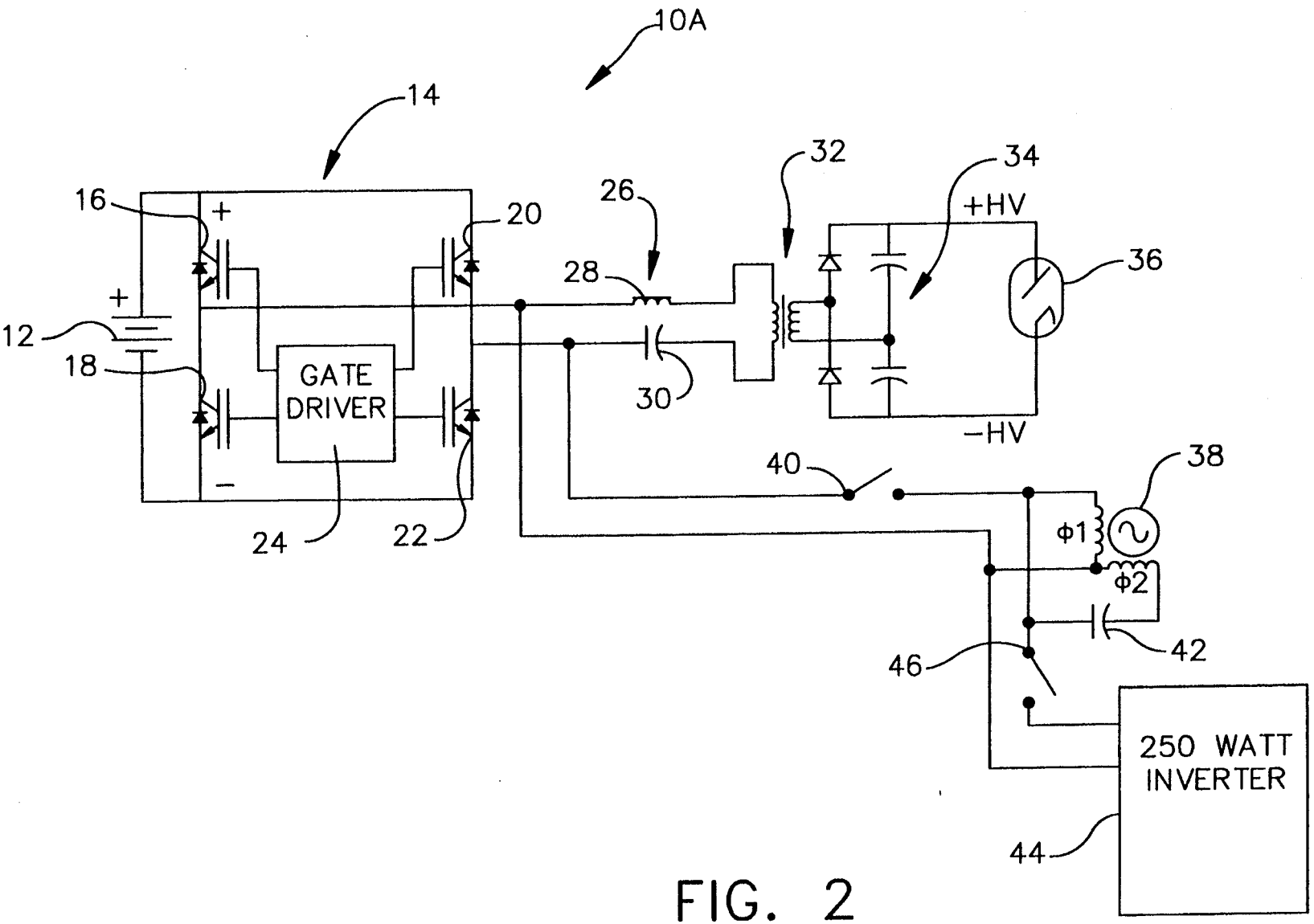
FIG. 2 is an electric circuit diagram as shown in FIG. 1, in accordance with an alternative embodiment of the present invention.

Referring now to FIG. 2, there is illustrated a circuit 10A, which is an alternative embodiment of the present invention. The embodiment illustrated in FIG. 2 is particularly useful in applications such as Computed Axial Tomography, where exposures may be made over a long period of time. In Computed Axial Tomography applications, the embodiment shown in FIG. 1 may result in the anode speed decaying too far. In such applications, then, a second small inverter 44 and a second switch 46 are added to the circuit of FIG. 1 to maintain the rated anode speed.

In the circuit 10A of FIG. 2, during acceleration of the anode, the induction motor 38 is connected by the switch 40 to the output of the full bridge 14, which generates a bipolar square wave output at a synchronous frequency corresponding to the desired operating speed of the motor 38. As described above with reference to FIG. 1, during acceleration, the x-ray load and the series resonant circuit 26 are left connected to the full bridge. Once the anode is up to operating speed, the motor disconnect switch 40 is opened. In the embodiment illustrated in FIG. 2, rather than allow the anode to coast down, the second switch 46 is closed to connect the motor 38 to the second inverter 44, to maintain the rated anode speed.

In some x-ray generators, there may be separate anode and cathode inverters. Advantage of this arrangement may be taken to eliminate the phase shifting capacitor driving the second phase of the anode driver motor by driving the second phase with a third inverter, wherein the third inverter is a two-phase inverter with one phase electronically phase shifted by 90° with respect to the other phase. This embodiment is shown in FIG. 3, wherein a circuit 10B comprises two main inverters 14 and 48, and a third smaller two-phase inverter 64 which is 90 degrees phase shifted during motor 38 acceleration.

Figure 3:
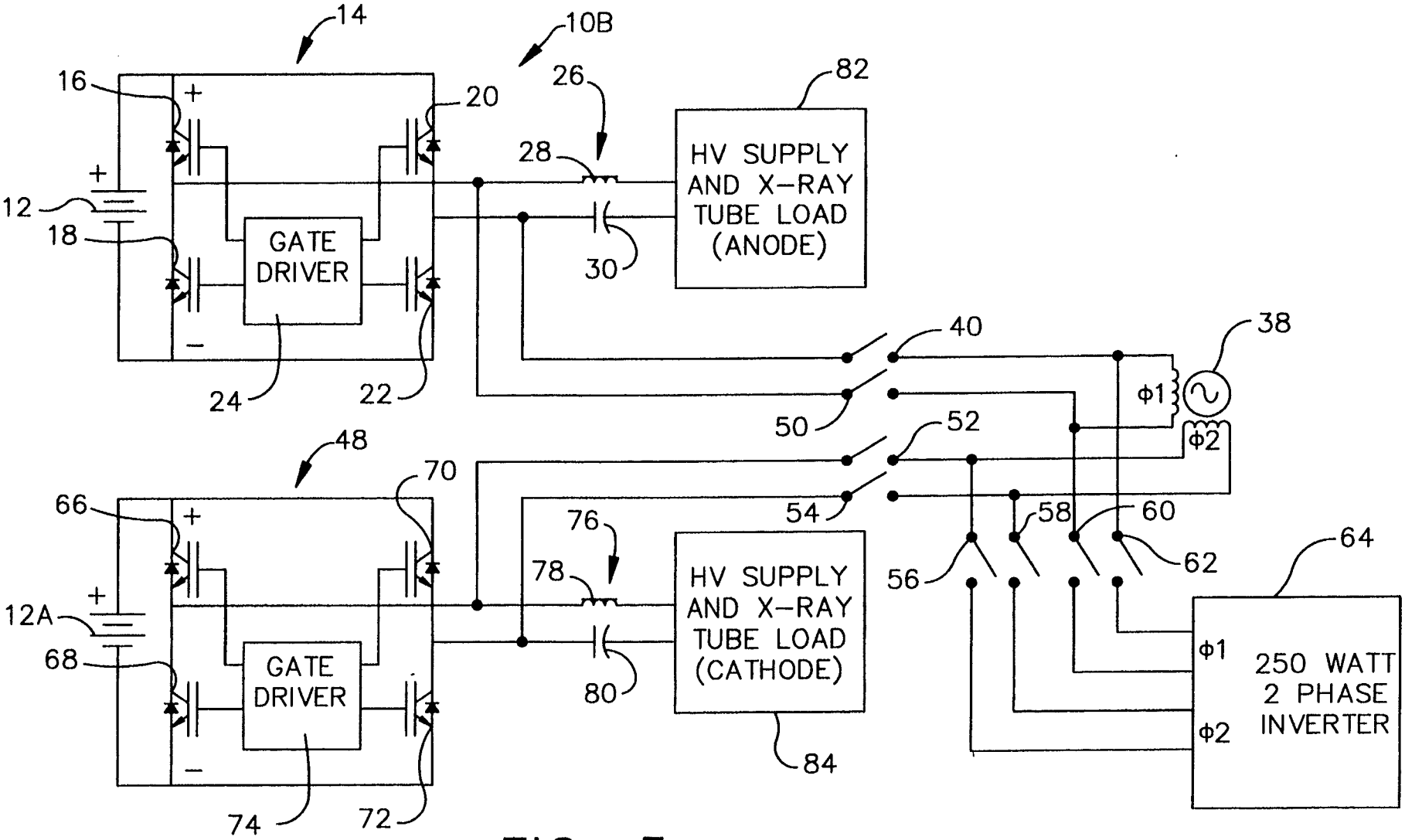
FIG. 3 is an electric circuit diagram similar to the circuit shown in FIG. 2, in accordance with a third embodiment of the present invention.

During acceleration of the anode, the induction motor 38 of FIG. 3 is a two-phase induction motor connected by switches 40, 50, 52, and 54 to the output of the full bridges 14 and 48, which generate bipolar square wave outputs at a synchronous frequency corresponding to the desired operating speed of the motor 38. As described above with reference to FIGS. 1 and 2, during acceleration, the x-ray load and the series resonant circuits 26 and 76 are left connected to the full bridges 14 and 48, respectively. Once the anode is up to operating speed, switches 40, 50, 52 and 54 opened, and switches 56, 58, 60 and 62 are closed, to take the two windings of the motor 38 and connect them to the third, small, two-phase inverter 64 to maintain the rated anode speed.

Continuing with FIG. 3, a DC voltage source 12A supplies voltage to the cathode inverter, which is a full bridge inverter 48 comprising four electronic switches 66, 68, 70 and 72, and a gate driver 74. The electric circuit 10B further includes a resonant circuit 76 comprised of a series connected inductor 78 and a capacitor 80. The circuit 10B further includes series connected outputs 82 and 84, for the anode and cathode, respectively, of the x-ray tube. The phase shifting capacitor 42 of FIGS. 1 and 2 is eliminated in FIG. 3, since the two-phase inverter 64 now drives the second phase of the anode driver motor 38, electronically phase shifted by 90°.

The invention has been described in detail with particular reference to certain preferred embodiments thereof, but it will be understood that modifications and variations can be effected within the spirit and scope of the invention.

What we claim as new and desire to secure by Letters Patent of the Unites States is:

1. An x-ray tube rotor controller comprising a DC voltage source, a rotary anode drive circuit including a rotary anode motor designed as an induction motor for driving the x-ray tube anode, characterized in that the x-ray tube rotor controller comprises a first inverter circuit having a full bridge arrangement for accelerating the anode using a first switch to connect the induction motor to the full bridge output, and further for generating high voltage for the x-ray tube using the full bridge, wherein the first switch is disconnected from the rotor when the motor reaches a rated anode speed, a second switch connects the motor to the second inverter to maintain the rated anode speed during x-ray exposure.

2. The x-ray tube rotor controller as claimed in claim 1 further characterized in that the x-ray tube rotor controller comprises a phase shifting capacitor.

3. An x-ray tube rotor controller as claimed in claim 1 wherein the rotor during coast has a very slow deceleration speed.

4. An x-ray tube rotor controller as claimed in claim 1 further characterized in that the x-ray tube rotor controller comprises a high voltage step up transformer and a rectifier and filter circuit for providing a series connected output for the x-ray tube.

5. An x-ray tube rotor controller comprising a DC voltage source, a rotary anode drive circuit including a rotary anode motor designed as a two-phase induction motor for driving the x-ray tube anode, characterized in that the x-ray tube rotor controller comprises an anode inverter circuit and a separate cathode inverter circuit, the anode and cathode inverter circuits each having a full bridge arrangement for accelerating the anode using a first switching means to connect the two-phase induction motor to the full bridge output of each inverter circuit, and further for generating high voltage for the x-ray tube, and further comprising a second switching means for connecting the two windings of the motor to a third inverter to maintain a rated anode speed of the motor.

6. An x-ray tube rotor controller as claimed in claim 5 wherein the anode and cathode inverter circuits produce voltage for the x-ray tube, once the second switching means is engaged.

7. An x-ray tube rotor controller as claimed in claim 5 wherein the cathode inverter is electronically phase shifted from the anode inverter during acceleration of the motor.

8. An x-ray tube rotor controller as claimed in claim 7 wherein the cathode inverter is 90° phase shifted from the anode inverter during acceleration of the motor.

9. An x-ray tube rotor controller comprising a DC voltage source, a rotary anode drive circuit including a rotary anode motor designed as an induction motor for driving the x-ray tube anode, characterized in that the x-ray tube rotor controller comprises a first inverter circuit having a full bridge arrangement for accelerating the anode using a first switch to connect the induction motor to the full bridge output, and further for generating high voltage for the x-ray tube using the full bridge, wherein the first switch is disconnected from the rotor causing the rotor to coast, and further comprises a second inverter for maintaining the rotor at speed during x-ray exposure, wherein when the first switch is disconnected from the rotor when the motor reaches a rated anode speed, a second switch connects the motor to the second inverter to maintain the rated anode speed.

* * * * *